United States Patent [19]

Goldman et al.

[11] 3,949,631

[45] Apr. 13, 1976

[54] PUNCHING HOLES IN THIN SHEET MATERIAL

[75] Inventors: Rubin Goldman, Newton Highlands; Morris Meyerkopf, West Roxbury, both of Mass.

[73] Assignee: Rubin Goldman, Brockton, Mass.

[22] Filed: Oct. 3, 1974

[21] Appl. No.: 511,719

[52] U.S. Cl. ..... 83/98; 83/639; 83/140; 83/206; 83/375; 83/390; 83/456; 83/124

[51] Int. Cl.[2] ..... B26D 7/02; B26D 7/06

[58] Field of Search ..... 83/206, 282, 375, 385, 83/390, 452, 456, 460, 639, 98, 124, 140

[56] References Cited

UNITED STATES PATENTS

| | | | |
|---|---|---|---|
| 1,493,994 | 5/1924 | Lefere | 83/124 |
| 2,251,135 | 7/1941 | Iknayan et al. | 83/124 |
| 2,579,940 | 12/1951 | Lobrovich | 83/98 |
| 3,501,987 | 3/1970 | Schneider | 83/390 |

*Primary Examiner*—Donald R. Schran
*Attorney, Agent, or Firm*—Wolf, Greenfield & Sacks

[57] ABSTRACT

An apparatus for punching holes in thin sheet stock includes an improved clamping arrangement which holds the sheet stock firmly during the punching operation in the regions surrounding the hole to be cut as well as in the slug region which is to be cut from the sheet.

10 Claims, 10 Drawing Figures

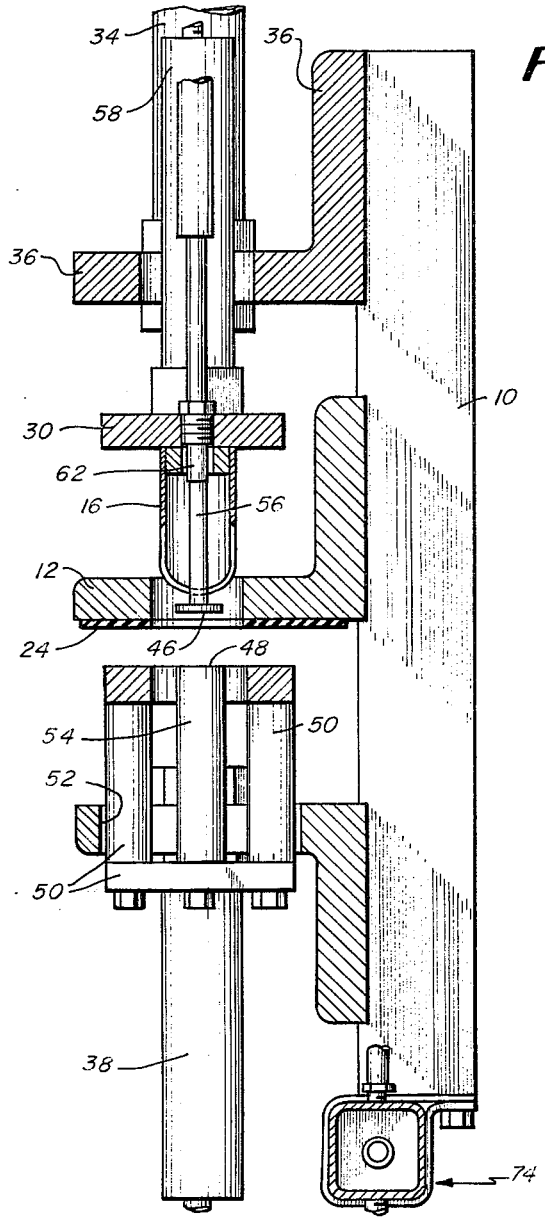
FIG. 6
FIG. 1
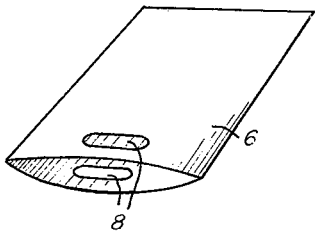
FIG. 8
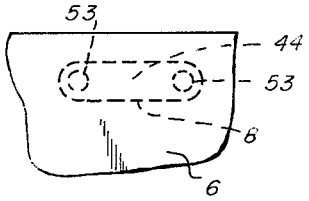
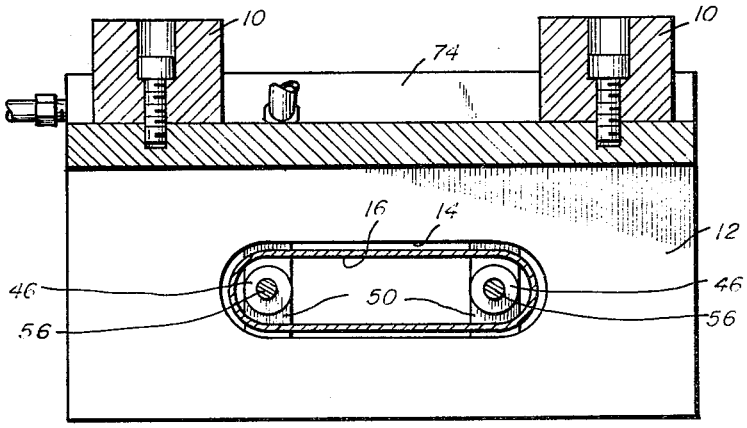
FIG. 7

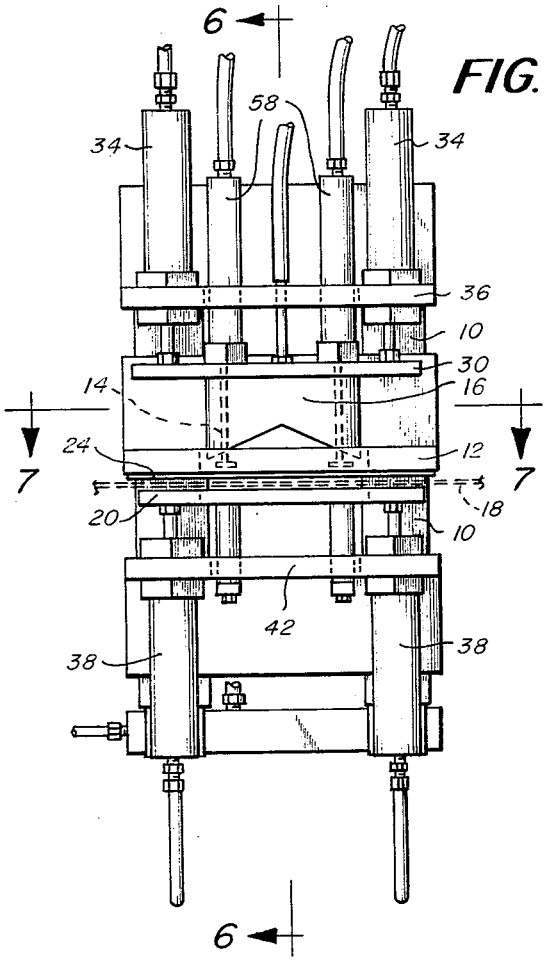
FIG. 2
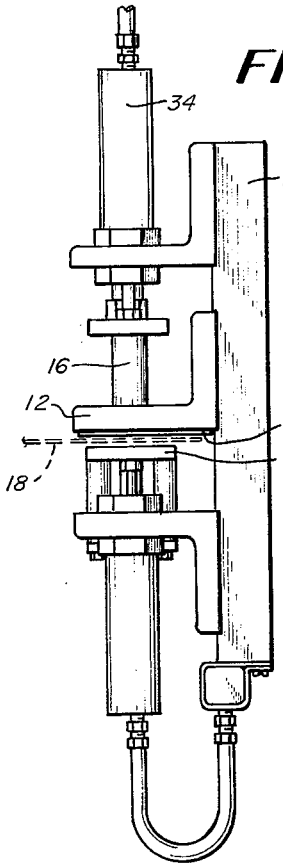
FIG. 3
FIG. 4
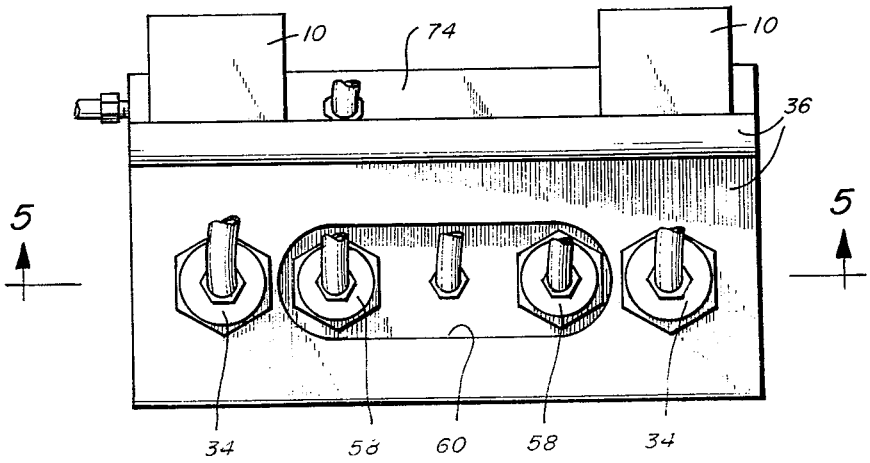

PUNCHING HOLES IN THIN SHEET MATERIAL

BACKGROUND OF THE INVENTION

This invention relates to an improved technique and apparatus for forming holes in thin sheet stock, such as plastic sheet of the order of a few mils thickness and, particularly to improvements in the formation of relatively large holes therein. For example, it often is desirable to form large holes to define a handle in bags made from thin sheet material such as polyethylene. Such bags have received increasing acceptance in recent years and are now in substantially wide spread use in a variety of environments. Because of the thin and highly flexible nature of the sheet material from which the bag is made, punching of such larger holes presents a number of difficulties which are not normally encountered in the punching of relatively small holes (e.g., for ventilation). One of these difficulties results from the fact that when punching a relatively large hole, the slug portion is not always completely and cleanly severed and may remain partly attached to the bag. This results from the fact that as the punching out of the slug progresses, the highly flexible nature of the thin sheet material enables the slug to be drawn along with the punch. The slug thus is not maintained in its intended substantially flat attitude as is desired at all times during the punching operation. In addition, failure to retain the slug portion of the sheet in a flat configuration during the punching operation may also result in an irregularly shaped hole even if the slug is completely severed from the sheet. It is among the primary objects of the invention to provide an improved apparatus and technique for punching such enlarged holes in thin, flexible sheet material while avoiding the foregoing and other difficulties.

SUMMARY OF THE INVENTION

In brief, the invention is incorporated in a punch assembly having a pair of flat main clamping members to clamp the sheet. The flat clamping members have aligned openings formed therethrough through which a punch may be driven. The punch is of hollow construction and has a sharpened lower edge which defines the shape of the hole to be made. The punch is driven through the openings of the clamp members to sever the slug region of the sheet and leave an opening of the shape of the sharp edge of the punch. In order to insure that the slug portion of the sheet will be disposed in a substantially flat attitude during the complete punching operation means are provided for independently clamping that portion of the sheet which is to define the slug. The slug clamping means includes upper slug clamp members mounted for movement in unison with the punch and which cooperate with lower slug clamp members mounted to the lower of the main clamps. After the main clamps have gripped the sheet and the punch is advanced toward the sheet, the upper and lower slug clamps cooperate to grip the slug region of the sheet just before the punch begins to sever the slug and maintains the grip on the slug throughout the complete punching operation.

It is among the objects of the invention to provide an improved method and apparatus for punching relatively large holes in thin flexible sheet material.

A further object of the invention is to provide a device of the type described in which it is assured that the hole will be cut cleanly and fully, with no portion of the slug remaining attached to the sheet stock.

A further object of the invention is to provide a device of the type described which may be employed in connection with conventional plastic bag making machinery or the like.

DESCRIPTION OF THE DRAWINGS

The foregoing and other objects and advantages of the invention will be understood more fully from the following further description thereof, with reference to the accompanying drawings wherein:

FIG. 1 is an illustration of a bag having enlarged handle holes punched therein in accordance with the invention;

FIG. 2 is a front elevation of the machine;

FIG. 3 is a side elevation of the machine;

FIG. 4 is a plan view of the machine;

FIG. 6 is a sectional illustration of the machine as seen along the line 6—6 of FIG. 1;

FIG. 7 is a sectional illustration of the machine as seen along the line 7—7 of FIG. 1;

FIG. 8 is a somewhat diagrammatic plan illustration of a portion of a web of material and illustrating in phantom the locations of the slug region and slug clamping region;

DESCRIPTION OF THE PREFERRED EMBODIMENT

Figure 5:
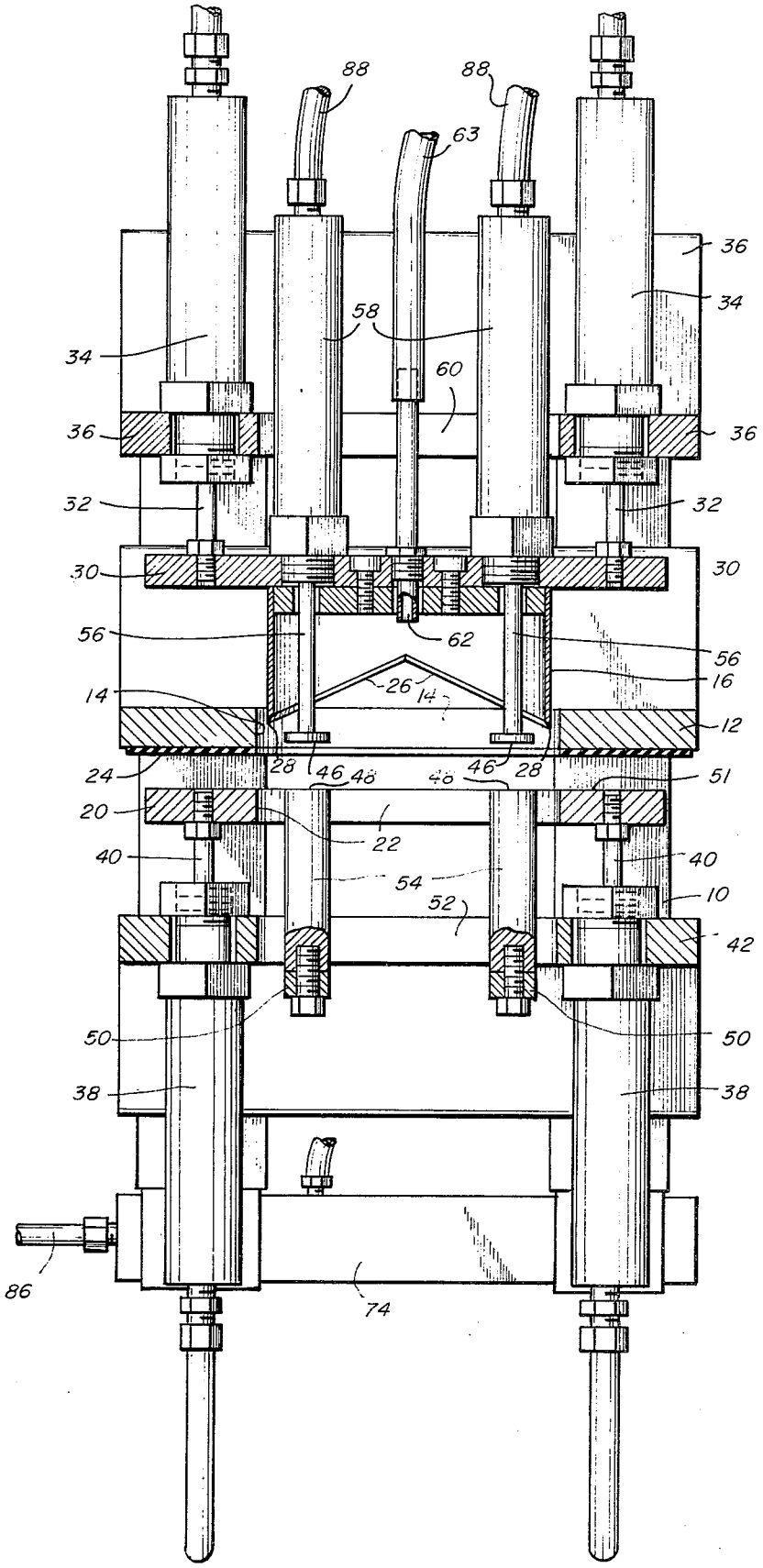
FIG. 5 is a sectional front elevation of the machine as seen along the line 5—5 of FIG. 4.

FIG. 1 is an illustration of a bag 6 which may be made from thin plastic film and which may have holes 8 punched therein to define a manually grippable handle. The bag may be formed from a sheet of plastic film by any of a variety of conventional apparatus which includes means for feeding, folding, sealing and cutting the sheet to the bag configuration.

The hole forming apparatus includes a frame 10 which may be mounted by any convenient means to the bag making machine or similar machine having a movable web of material in which it is desired to form the enlarged hole. A die plate 12 is secured to the frame and has an opening 14 formed therein with a shape which corresponds generally to the shape of the hole to be formed but which is somewhat larger than the intended size of the hole. In the embodiment illustrated the opening 14 is of a shape so as to form an elongate hole having smoothly rounded ends which will be suitable to define an easily grippable handle opening in the sheet material from which the bag is made as suggested in FIG. 1. A punch 16 is mounted above the die plate 12 in alignment with the opening 14 and is movable vertically through the opening 14 to punch a hole in the sheet material 18 as described below. The sheet 18 is held firmly against the underside of the die plate 12 during the punching operation by a clamp plate 20 which is movable upwardly against the underside of the die plate 12 and which also has an opening 22 of the same shape as the opening 14 in the die plate 12 to enable the punch to pass therethrough. The underside of the die plate 12, against which the sheet material 18 is clamped preferably is provided with a resilient pad 24 which may be made from rubber or other appropriate material capable of providing a good frictional grip on the sheet 18 yet which will not damage or mar the sheet material.

The punch 16 is of generally hollow, tubular shape and may be formed from an appropriate sheet metal. The lower edge 26 of the punch is sharpened. The lower edge 26 of the punch may be of inverted V-shaped configuration as shown in FIGS. 2 and 5 in which the edge 26 extends downwardly and laterally outwardly from the center of the punch to terminate, at the lateral ends of the punch in relatively sharp points 28. The openings 14, 22 are dimensioned to be larger than the punch so that there is no wear between the punch 16 and either of the die plate 12 or clamp plate 20 during the punching operation. This results in substantially increased punch life as described in my U.S. Pat. No. 3,524,368, issued Aug. 18, 1970.

The punch 16 is mounted for vertical movement by securing it to a support plate 30 which, in turn, is secured to the ends of the piston rods 32 of a pair of pneumatic cylinders 34. The cylinders 34 are secured to a bracket 36 which is mounted to the frame 10, the pneumatic cylinders 34 being disposed to drive the support plate 30 and punch 16 in an upward-downward direction. The cylinders 34 include internal springs which bias the piston rods 32 upwardly to maintain the punch 16 in an upper position when the device is idle.

The clamp plate 20 is mounted for its vertical movement toward and away from the underside of the die plate 12 by means of a pair of pneumatic cylinders 38 having upwardly extending piston rods 40, the clamp plate 20 being secured to the ends of the piston rods 40. The pneumatic cylinders 38 are supported in laterally spaced relation as shown on a bracket 42 which is secured to the frame 10.

With the foregoing arrangement the sheet material in which the hole is to be cut may be clamped between the clamp plate 20 and pad 24 to provide firm support for the sheet material fully about the region where the hole is to be cut thus insuring that that portion of the sheet will not be drawn inwardly or downwardly as the punch engages the sheet material. As mentioned above in the punching of larger sized holes, merely effecting a clamp fully around the region from which the hole is to be cut does not always result in a satisfactorily formed hole. This is believed to result from the fact that while the slug region, indicated diagrammatically at 44 in FIG. 8 may be held taut during the beginning of the punching operation, as the punching operation continues toward completion there is progressively less connection between the slug region 44 and the surrounding region 6 of the sheet, thus progressively reducing support for the slug region 44. Reduced support for the slug region 44, in turn, results in an incomplete cut or a cut which is not of satisfactory smoothness.

In order to insure that both the surrounding region 6 of the sheet 18 as well as the slug region 44 of the sheet will be properly supported at all times during the punching operation, means are provided for independently clamping the slug region 44 and for maintaining a firm grip on the slug region 44 during the punching operation. To this end, the machine may be provided with a pair of upper slug clamping pads 46 and a pair of lower slug clamping pads 48. The upper and lower pads 46, 48 are normally spaced when the machine is in an idle position and are brought together before the punch 16 engages the sheet material 18 so that when the punch does engage the sheet material the slug region

44 will be clamped firmly. In the embodiment shown the lower slug clamps 48 are secured to the clamp plate 20 by means of U-shaped brackets 50 (see FIG. 6) which are suspended from the underside of the clamp plate 20 and are movable therewith. A hole 52 may be formed in the lower bracket 42 to provide clearance for the vertical movement of the U-brackets 50. An upwardly extending post 54 is secured to the bight of each of the U-brackets 50 and the upper ends of the posts 54 serve as the lower slug clamps. The ends 48 of the posts 54 are located at the same level as and lie within substantially the same plane as that of the upwardly facing sheet-engaging surface 51 of the clamp plate 20. Thus, the pair of lower slug clamp pads are disposed within the opening 22 of the clamp plate 20 and may engage the underside of sheet material 18 simultaneously with engagement of the sheet material by the clamp plate 20. FIG. 8 shows diagrammatically, by the reference character 53, the relative location of the slug clamping members 46, 48 with respect to the slug region 44.

The upper slug clamp pads 46 are disposed above and in alignment with the lower slug clamp pads 48. Each of the upper slug clamp pads 46 is secured to the end of a piston rod 56 of a pair of pneumatic cylinders 58 which are mounted to the punch carrier plate 30 for movement in unison therewith. A hole 60 may be formed in the upper bracket 36 to provide clearance for the upper ends of the pneumatic cylinders 58 as they reciprocate vertically with the punch carrier plate 30. The pneumatic cylinders 58 are continually under pressure to continually bias their piston rods 56 downwardly and in an extended position. The piston rods 56 are of a length such that when the machine is in an idle position, the upper slug clamp pads 46 will be disposed slightly below the lowermost portion of the edge 26 of the punch, here the laterally disposed punch points 28. As will be described more fully below, in the operation of the device the pneumatic cylinders 38 are first operated to raise the clamp plate 20 and the lower slug clamp pads 48. The pneumatic cylinders 34 then are operated to drive the punch carrier plate 30 downwardly. Before the ends 28 of the sharpened edge 26 of the punch 16 engages the sheet material 18 to begin the punching operation, the upper slug clamp pads 46 engage the upper surface of the sheet material 18 to grip the slug portion 44 between the upper and lower slug clamp pads 46, 48 thus insuring that as the stroke of the punch 16 continues the slug region 44 as well as the surrounding region 6 of the sheet material 18 will be held firmly during the entire slug punching operation. The slug thus is clamped within the region defined by the edge 26 of the punch 16 and the hollow punch 16 surrounds and passes over the pad supporting posts 54 during the punch operation. The piston rods 56 retract into their respective cylinders as the punch 16 moves downwardly and will remain in firm clamping engagement with the slug under the influence of the constant bias of the pneumatic cylinders 58. After the punching operation has been completed and the punch carrier 30 is retracted upwardly, a blast of air may be directed through a port 62 located within the interior of the punch 16 to blow the cut slug 44 downwardly out of the way in a manner as described in my prior U.S. Pat. No. 3,524,368.

Figure 9:
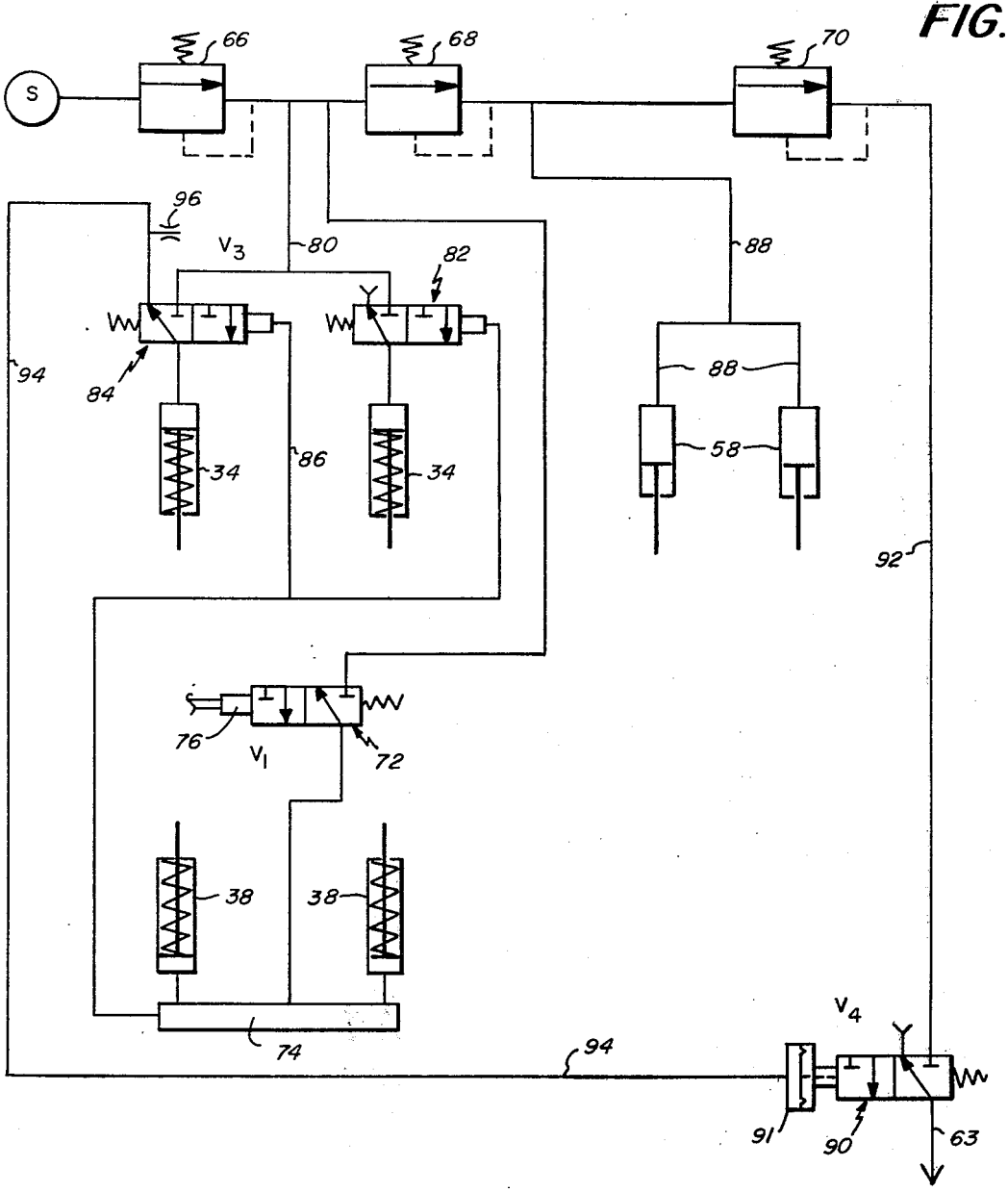
FIG. 9 illustrates the pneumatic control circuitry employed in the operation of the machine.

FIG. 9 illustrates the pneumatic circuit for controlling the sequence of operation of the various elements of the machine. The pneumatic control circuitry includes a source 64 of air under pressure which may be connected to a series of pressure regulators 66, 68, 70 to provide a number of working pressures for the various pneumatically operated elements of the device. The pressure is provided to the lower clamp cylinders 38 through a solenoid operated valve 72 and a manifold 74. Valve 72 is biased in normally closed configuration and may be switched to an open configuration to fill the manifold 74 with air under pressure in response to operation of a solenoid pilot control 76 associated with the valve. The solenoid 76 may be operated by any convenient means in suitable phase with the intermittent movement of the web in which the holes are to be punched. Thus, when the machine is in an idle position, the piston rods of the lower cylinders 38 will be in their lowered, retracted positions, under the influence of the springs within the cylinders to maintain the clamp plate 20 and lower slug clamp pads 48 below the pad 24 on the underside of the die plate 12. It may also be noted that the upper pneumatic cylinders 34 are also in a retracted configuration when the machine is idle. Each of these cylinders is connected through line 80 and valves 82, 84 to the outlet from pressure regulator 66. Valves 82, 84 are normally vented to the atmosphere so that the piston rods of the cylinders 34 will be biased upwardly under the influence of the internal springs of the cylinders thus maintaining the punch 16 and upper slug clamp pads 46 in their most upward position. Valves 82, 84 are of the air piloted variety and can be shifted to connect air under pressure from line 80 to the pneumatic cylinders 34. Valves 82, 84 are piloted through line 86 which is connected to the manifold 74. Valves 82, 84 may be set so that the pressure required to shift them is slightly greater than that required to extend fully the piston rods of the lower cylinders 38 thus insuring a slight delay between the time that the clamp plate 20 is raised fully and the time in which the punch carrier 30 is advanced downwardly to form the hole.

The upper pneumatic cylinders 58 for continually biasing the upper slug clamp pads 46 in a downward direction are connected directly through line 88 to the outlet of intermediate stage pressure regulator 68. The slug blow-through port 62 is connected through a valve 90 and through line 92 to the outlet of the third stage pressure regulator 70. Valve 90, however, is normally biased in a closed configuration and may be piloted to an open configuration when there is a pressure pulse in line 94. Valve 90 is associated with a pulse sensitive device such as a diaphragm 91. Line 94 is in turn connected to the exhaust port of one of the valves associated with the upper cylinders such as the valve 84 and the valve exhaust in line 94 are exhausted to the atmosphere through a restricted outlet orifice 96. This configuration enables the line 94 to be pulsed briefly as the cylinders 34 raise the punch to pilot valve 90 and connect the air in line 92 to flow through valve 90 and through the port 62 to effect the desired blow-out of the slug.

Figure 10:
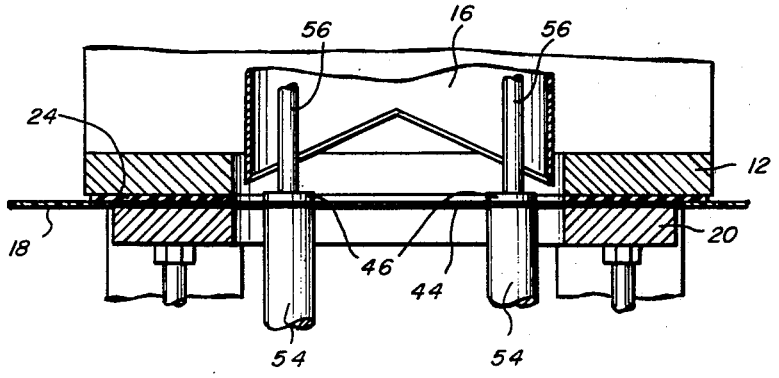
FIG. 10 is an illustration of the fully clamped web in readiness to be punched.

Summarizing the operation of the machine the web of thin sheet material 18 is advanced by the bag making machine or other web advancing apparatus. When the web stops momentarily solenoid 76 is triggered to pilot valve 72 to actuate cylinders 38 and raise the clamp plate 20 to firmly grip the web between the plate 20 and the pad 24 at the underside of the die plate 12. When the sheet is thus firmly gripped, the back pressure in the manifold 74 will rise to the level required in order to pilot valve 82 and 84 through line 86, thus making operation of the cylinders 34 responsive to the clamping of the sheet between plate 20 and plate 12. The delay in operation need only be of the order of a fraction of a second or just sufficient to insure that the sheet is first firmly clamped. When valves 82, 84 are shifted, air under pressure is communicated from regulator 66 through line 80 and through the valves 82, 84 to the cylinders 34 to urge the plate 30 downwardly. At this time the upper slug clamping pads 46 are in their most extended positions, slightly below the lowest portion of the sharpened punch edge 26, 28 and are continually biased downwardly under the influence of the pneumatic cylinders 58 which are actuated at all times. The upper slug clamping pads 46 engage the upper surface of the sheet in the slug region 44 and cooperate with the already raised lower slug clamping pads to firmly hold the slug region 44 before the punch 16 engages the sheet material. The configuration of the various parts of the device just before the punch 16 engages the sheet material 18 is suggested diagrammatically in FIG. 10. The cylinders 34 then continue to drive the punch 16 downwardly through the sheet material to sever the slug 44 cleanly. The solenoid control 76 of valve 72 then is deactivated, as by a suitable timing device, which enables the air in lower cylinders 38 to be exhausted through the manifold 74 and which also deactivates the pilot controls for valves 82, 84 as the air in line 86 also exhausts through the manifold 74 and valve 72. This shifts valves 82, 84 to their normally closed configuration and enables the springs in the cylinders 34 to return them to their idle positions. As the cylinders return to their idle positions and raise the punch 16 and other elements mounted to the punch carrier plate 30, air is exhausted through the restricted orifice 96. The size of the orifice is such that there will be a pressure pulse in line 94 which will shift valve 90 to enable air to flow from line 92 through line valve 90 and through the port 62 to blow the cut slug out of the way.

It should be noted that while the invention has been described with particular reference to the formation of enlarged holes in thin plastic bags, it may be used in any similar environment where it is desirable to punch an enlarged hole in one or more thicknesses of relatively thin sheet material.

It should be understood that the foregoing description of the invention is intended merely to be illustrative thereof and that other modifications and embodiments may be apparent to those skilled in the art without departing from its spirit.

Having thus described the invention what we desire to claim and secure by Letters Patent is:

1. A device for forming an enlarged hole in sheet material comprising:

first clamping means for clamping said sheet material about a region where said hole is to be formed, said first clamping means having an opening formed therethrough at said region;

slug clamping means for clamping said sheet within said region thereof which is disposed within said opening defined by said first clamping means; and punch means mounted for movement through said opening and about said slug clamping means for severing a slug of said sheet material from within said region of said sheet material.

2. A device as defined in claim 1 further comprising:

means for delaying operation of said punch means until said first clamping means and said slug clamping means have fully clamped their respective portions of said sheet material.

3. A device as defined in claim 1 further comprising:

means for maintaining each of said first clamping means and said slug clamping means in a clamped configuration until said punch means has passed fully through said sheet material.

4. A device as defined in claim 3 further comprising:

said punch being hollow and having an opening at its lower end, said opening being defined by a lower edge;

means for injecting an air blast into the hollow of said punch in a direction extending toward said open end thereof; and means for effecting said blast of air after said punch has completed its cutting stroke.

5. A device as defined in claim 1 wherein said first clamping means comprises:

a stationary clamp member having said opening formed therethrough;

a movable clamp member movable toward and away from one side of said stationary clamp member, said movable clamp member having an opening formed therethrough in alignment with said opening in said stationary clamp member;

said slug clamping means comprising:

at least one lower slug abutment member mounted for movement in unison with said movable clamp member and being exposed through said opening in said movable clamp member; and at least one upper slug abutment member mounted for movement in unison with said punch toward and away from said movable clamp member, each of said upper abutment members being disposed in alignment with a corresponding of said lower slug abutment members.

6. A device as defined in claim 5 further comprising:

said punch being hollow and having an opening at its lower end, said opening being defined by a lower edge;

said upper slug abutment member being mounted for movement with respect to said punch between a retracted position in which the lower edge of the punch extends beyond the lower end of the slug clamp member and an extended position in which the outer end of the slug clamp member extends beyond the lower end of the punch; and means biasing said upper slug clamp member toward its extended position.

7. A device as defined in claim 5 further comprising:

means for delaying operation of said punch means until said first clamp means has fully clamped said sheet material.

8. A device as defined in claim 5 furthur comprising:

a resilient pad formed from a material having a relatively high coefficient of friction, said pad being secured to at least one of the facing surfaces of said stationary and movable clamp members.

9. A device as defined in claim 6 further comprising:

at least one pneumatic cylinder mounted for movement in unison with said punch and having a piston rod extending downwardly therefrom through said punch;

an upper slug clamp mounted to the lower end of the piston rod and each of said pneumatic cylinders; and means for applying air under pressure to each of said pneumatic cylinders to continually bias said upper slug clamps in a downward direction.

10. A method for severing a relatively large slug from a sheet of thin flexible material comprising:

clamping said sheet material in a region thereof which surrounds an intended slug region;

also clamping said slug region independently of said other clamped region; and while effecting said clamping of both of said surrounding and slug regions, passing a piercing instrument through an opening in said first mentioned clamp and surrounding said second mentioned clamp.

* * * * *